US008695509B2

(12) United States Patent
Nedelik

(10) Patent No.: US 8,695,509 B2
(45) Date of Patent: Apr. 15, 2014

(54) REINFORCED LONGITUDINAL BEAM FOR A RAILWAY VEHICLE

(75) Inventor: Robert Nedelik, Vienna (AT)

(73) Assignee: Siemens AG Österreich, Vienna (AT)

( * ) Notice: Subject to any disclaimer, the term of this patent is extended or adjusted under 35 U.S.C. 154(b) by 0 days.

(21) Appl. No.: 13/641,957

(22) PCT Filed: Apr. 13, 2011

(86) PCT No.: PCT/EP2011/055745

§ 371 (c)(1),
(2), (4) Date: Oct. 18, 2012

(87) PCT Pub. No.: WO2011/134788

PCT Pub. Date: Nov. 3, 2011

(65) Prior Publication Data

US 2013/0036937 A1 Feb. 14, 2013

(30) Foreign Application Priority Data

Apr. 26, 2010 (AT) ..... A686/2010

(51) Int. Cl.
*B61D 25/00* (2006.01)

(52) U.S. Cl.
USPC ..... 105/396; 105/397

(58) Field of Classification Search
USPC ..... 105/392.5, 396, 397, 399, 400, 401, 105/402, 404
See application file for complete search history.

(56) References Cited

U.S. PATENT DOCUMENTS

| | | | | |
|---|---|---|---|---|
| 2,286,954 | A * | 6/1942 | Clarke et al. | 105/418 |
| 4,563,957 | A * | 1/1986 | Billingsley et al. | 105/418 |
| 4,800,820 | A * | 1/1989 | Tomaka | 105/406.1 |
| 5,685,229 | A * | 11/1997 | Ohara et al. | 105/397 |
| 5,715,757 | A * | 2/1998 | Dannawi et al. | 105/392.5 |
| 7,478,600 | B2 * | 1/2009 | Beers et al. | 105/423 |
| 7,971,926 | B2 * | 7/2011 | Lemmons | 296/186.1 |
| 8,424,462 | B2 * | 4/2013 | Umebayashi et al. | 105/396 |
| 2002/0096913 | A1 * | 7/2002 | Moriaux | 296/190.02 |

FOREIGN PATENT DOCUMENTS

| | | | |
|---|---|---|---|
| EP | 0260200 | A1 | 3/1988 |
| EP | 1832491 | A2 | 9/2007 |
| WO | WO 02070319 | A1 | 9/2002 |
| WO | WO 2011038751 | A1 | 4/2011 |

* cited by examiner

*Primary Examiner* — Jason C Smith

(57) ABSTRACT

A reinforced longitudinal beam for railway vehicles includes a first partial beam and a second partial beam. The first partial beam is connected to a second assembly of the railway vehicle and the second partial beam is connected to a first assembly of the railway vehicle. Particular surfaces are provided on the first partial beam for forming a welded connection to the second partial beam, and particular surfaces are provided on the second partial beam for forming a welded connection to the first partial beam, wherein one of the partial beams comprises an end facing.

9 Claims, 6 Drawing Sheets

REINFORCED LONGITUDINAL BEAM FOR A RAILWAY VEHICLE

CROSS REFERENCE TO RELATED APPLICATIONS

This application is the US National Stage of International Application No. PCT/EP2011/055745 filed Apr. 13, 2011, and claims the benefit thereof. The International Application claims the benefits of Austrian Application No. A 686/2010 AT filed Apr. 26, 2010. All of the applications are incorporated by reference herein in their entirety.

FIELD OF INVENTION

The invention relates to a reinforced longitudinal beam for a railway vehicle and a railway vehicle with such a longitudinal beam.

BACKGROUND OF INVENTION

Today railway vehicles, in particular passenger vehicles, are in practice only constructed as self-supporting metal structures. A vehicle body comprising a substructure, side walls, end walls and a roof is constructed. The substructure must withstand operating forces, in particular loading, clutch pressure and tensile forces. For this reason the substructure is frequently designed as a frame and usually comprises two external longitudinal beams as well as several cross-members connecting these longitudinal beams and is reinforced at the ends of the vehicle.

The economic production of railway vehicles requires a high level of automation during manufacture. In particular, the production of a large number of welded connections should be automated. Consequently, today automated production of the substructures, side walls and the roof already takes place on suitable welding machines. The connection of the substructure to the side walls or the side walls to the roof can currently only be performed partially by means of automatic welding, as all known welding machines must be able to readily access the welded seams. However, the welded seams between the substructure and the side walls or between the side walls and the roof inside the wagon body are only accessible with difficulty and must be produced manually. In order to provide connection points which can be welded using automation, WO 2011/038751 A1 discloses a divided longitudinal beam, wherein one part of said longitudinal beam is welded to one major component (substructure, side wall or roof) in each case, and which has straight, readily accessible connection points which can be welded using automation when the associated major component is added. If this solution is used for the side wall/substructure connection point, then penetration of the cross-members of the substructure into the part of the longitudinal beam which is assigned to the substructure is necessary. These penetrations require that one of the welds which connect the two parts of the longitudinal beam to a closed profile must be interrupted at these connection points. This penetration cannot be omitted in such a longitudinal beam for reasons of strength, however.

DESCRIPTION OF THE INVENTION

An object is to specify a longitudinal beam for railway vehicles which permits the automated welding of the connection points between the major components (substructure, side walls, roof) of a railway vehicle, wherein the longitudinal beam is so strong that the penetration of the longitudinal beam by the cross-members of the substructure can be omitted.

The object is achieved by a longitudinal beam as claimed in the independent claim. Advantageous embodiments are the subject of subordinate claims.

According to the fundamental idea of the invention, a longitudinal beam is constructed for railway vehicles, which is divided in the longitudinal axis into a first partial beam and a second partial beam, wherein in each case a partial beam is fastened to a major component (substructure, side walls, floor) assigned to this partial beam. Both the partial beams are designed in such a way that they can be combined to form a longitudinal beam and can be connected to each other by means of welded connections, wherein both the partial beams together produce a longitudinal beam with a closed profile. One of the two partial beams is designed with an end facing so that this partial beam has an essentially triangular profile.

This makes the advantage of being able to connect major components of railway vehicles by means of straight and unbroken welded seams attainable, wherein these welded seams are readily accessible. As a result, welding machines can be used, which makes the production of railway vehicles faster and less expensive.

In addition, it is advantageous that a longitudinal beam with an end facing constructed in this way is essentially more rigid and more stable than the usual longitudinal beam with a U-profile or a cap profile or the longitudinal beam composed of partial beams, wherein by means of the end facing according to the invention of one of the partial beams a particularly high strength is achieved.

If necessary, a longitudinal beam according to the invention can be composed of metal with a thin wall thickness, resulting in advantages in terms of weight compared to standard longitudinal beams.

A major advantage of the invention is the reduction in penetration of one of the partial beams by the cross-members of the substructure. As a result this partial beam can be produced with fewer processing steps and can therefore be produced more rapidly and inexpensively. This penetration is necessary in divided longitudinal beams in order to ensure optimum transmission of force between a side-wall column and a cross-member. As a result of the increased strength of a longitudinal beam fitted with an end facing, it is no longer necessary. Consequently, the internal welded seam which connects the two partial beams to the side of the longitudinal beam facing the inside of the vehicle can be straight and unbroken over the entire length of the longitudinal beam. Such welded seams can also be produced by welding machines, which further favors the production of a railway vehicle.

A further major advantage of the invention is the improved transmission of forces between the connected major components. In particular, an offset in the longitudinal axis of the vehicle between the cross-members and the side-wall beams which is produced by the tolerances of vehicle manufacture is no longer disadvantageous as the flow of power is also ensured by means of the increased strength in the case of longitudinal offsetting.

In a further development of the invention recesses (perforations) are provided, which can typically be provided in the end facing and/or a bridge of a partial beam. As a result the interior of a reinforced longitudinal beam according to the invention is also accessible after closing the profile so that, for example, rust inhibitor or paints can be introduced via these perforations. In vehicles made of non-rusting materials these perforations are not necessary but can nonetheless be provided in order to save weight.

The partial beams are produced advantageously from sheet metal with the aid of bending methods. It is also possible to produce the partial beams by means of an extrusion method, wherein the welded seam to close the profile of the first partial beam is no longer necessary. These extrusion methods are suited in particular to the production of partial beams made of light metal.

EMBODIMENT OF THE INVENTION

Figure 1:
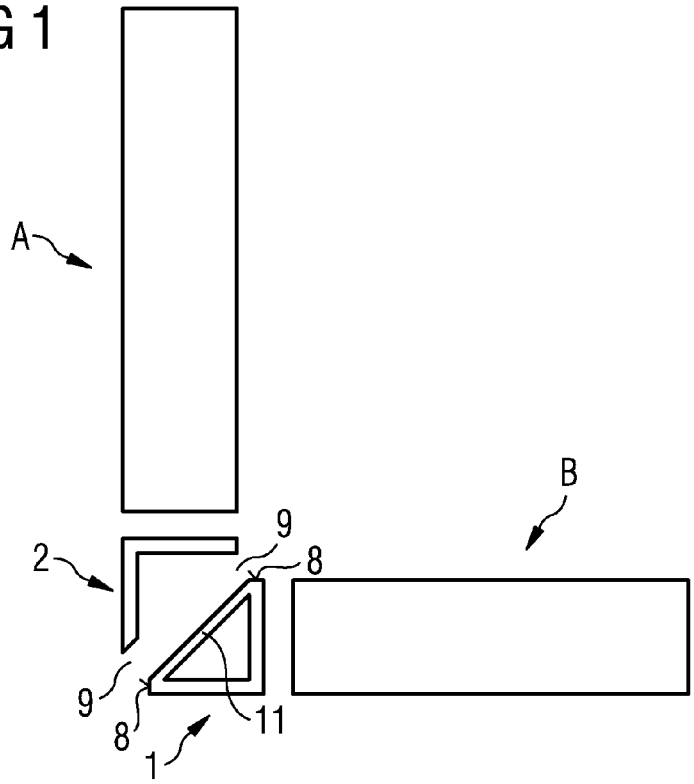
FIG. 1 Schematic diagram of a reinforced longitudinal beam for railway vehicles.

FIG. 1 shows in exemplary and schematic fashion a schematic diagram of a reinforced longitudinal beam for railway vehicles. The highly abstracted design principle of a longitudinally divided, reinforced longitudinal beam in the form of a section diagonal to the longitudinal axis is shown. The longitudinal beam is divided in the longitudinal axis into a first partial beam 1 and a second partial beam 2. The first partial beam 1 is connected to a second assembly B (for example, a substructure). The second partial beam 2 is connected to a first assembly A. The first partial beam 1 comprises welded surfaces 8 which are formed to connect to the second partial beam 2. The second partial beam 2 comprises welded surfaces 9 which are formed to connect to the first partial beam 1. During the joining process, in which the first assembly A is joined to the second assembly B, welded seams are made between the welded surfaces 8 of the first partial beam 1 and the welded surfaces 9 of the second partial beam 2 and partial beams 1 and 2 and consequently also the assemblies A and B are connected. These welded seams run in the longitudinal direction of the longitudinal beam (or of the railway vehicle) and can be automatically produced in practical embodiments of the longitudinal beam. The partial beams 1 and 2 form a closed profile when assembled, thus achieving a high level of rigidity in the longitudinal beam. In addition, the first longitudinal beam 1 has an end facing 11, as a result of which the first longitudinal beam 1 has an essentially triangular profile.

Figure 2:
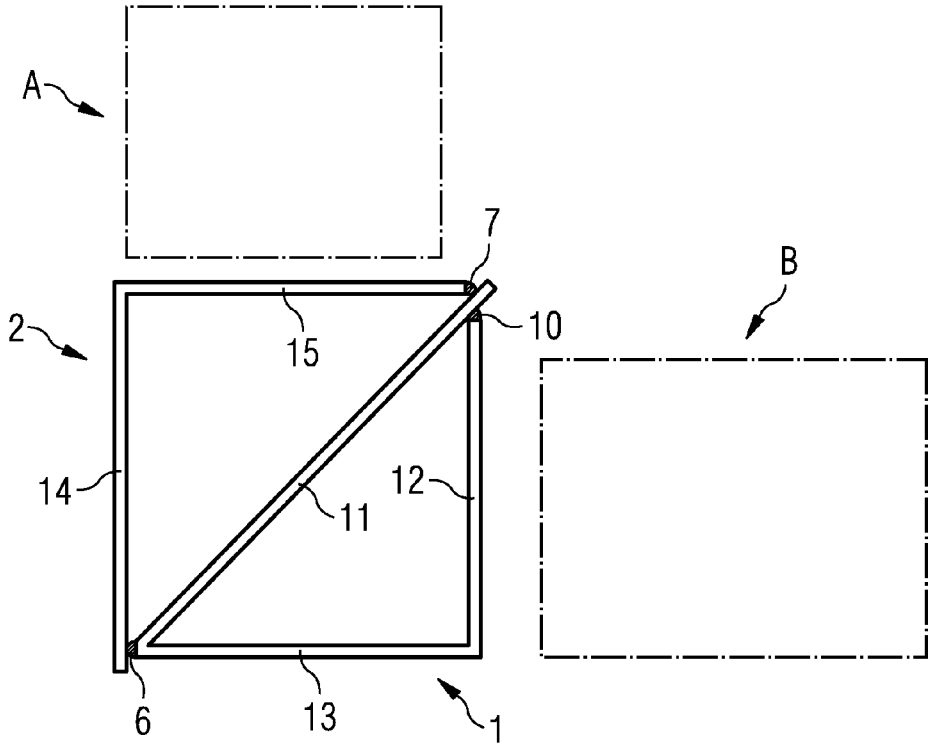
FIG. 2 Schematic diagram of a reinforced longitudinal beam for railway vehicles, details and welded seams.

FIG. 2 shows in exemplary and schematic fashion a schematic diagram of a reinforced longitudinal beam for railway vehicles, wherein details of the partial beams and welded seams are shown. A first partial beam 1 is shown, which comprises a bridge 12, a flange 13 and an end facing 11 and as a result has an essentially triangular closed profile. In general, such a partial beam 1 is particularly advantageously produced by means of bending devices from a metal strip. As a result it is necessary to close this essentially triangular profile of the beam by means of a longitudinal beam welded seam 10. A second partial beam 2 comprises a bridge 14 and a flange 15 and is formed in such a way that it can be connected to the first longitudinal beam 1 to form a longitudinal beam with a closed profile. An external welded seam 6 and an internal welded seam 7 are provided for this purpose. By using a reinforced longitudinal beam according to the invention, the internal welded seam 7 as well as the external welded seam 6 can form a straight and unbroken line over the entire length of the longitudinal beam, which favors the automatic manufacturability of this welded seam.

In addition, a first assembly A and a second assembly B are shown in order to clarify the installation position of a longitudinal beam according to the invention. The partial beams 1, 2 are first connected to the respectively assigned assembly A, B and subsequently to each other by means of the welded seams 6, 7.

Figure 3:
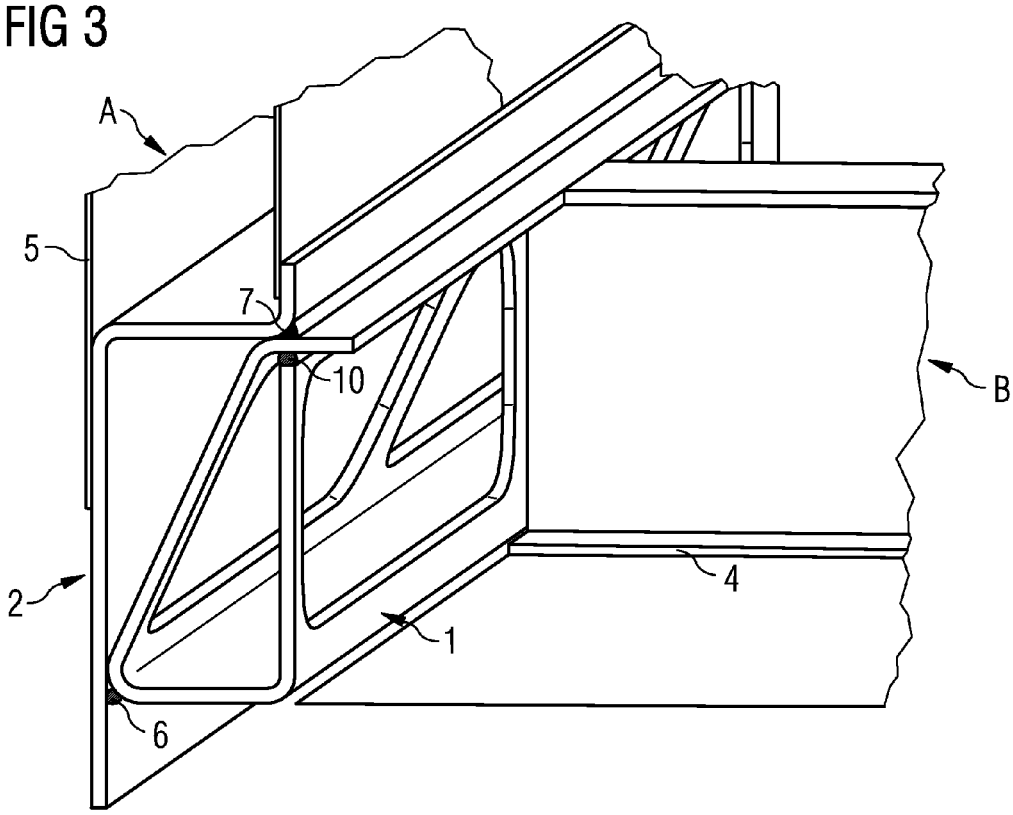
FIG. 3 Reinforced longitudinal beam for railway vehicles, substructure/side wall connection point.

FIG. 3 shows in exemplary and schematic fashion an exemplary embodiment of a reinforced longitudinal beam for railway vehicles at the substructure/side wall connection point. The longitudinal beam comprises a first partial beam 1 and a second partial beam 2. The first partial beam 1 has an essentially triangular profile and is welded by means of the longitudinal beam welded seam 10. A second assembly B (a substructure) is connected to the first partial beam 1, wherein a cross-member 4 of this substructure is shown in FIG. 3. The second partial beam 2 has an essentially L-shaped profile and is connected to a first assembly A (a side wall), wherein the covering 5 of this side wall is shown. An external welded seam 6 and an internal welded seam 7 connect the two partial beams 1 and 2 to each other and consequently also the assemblies A and B connected to the partial beams 1, 2. These welded seams 6 and 7 are straight and unbroken.

Figure 4:
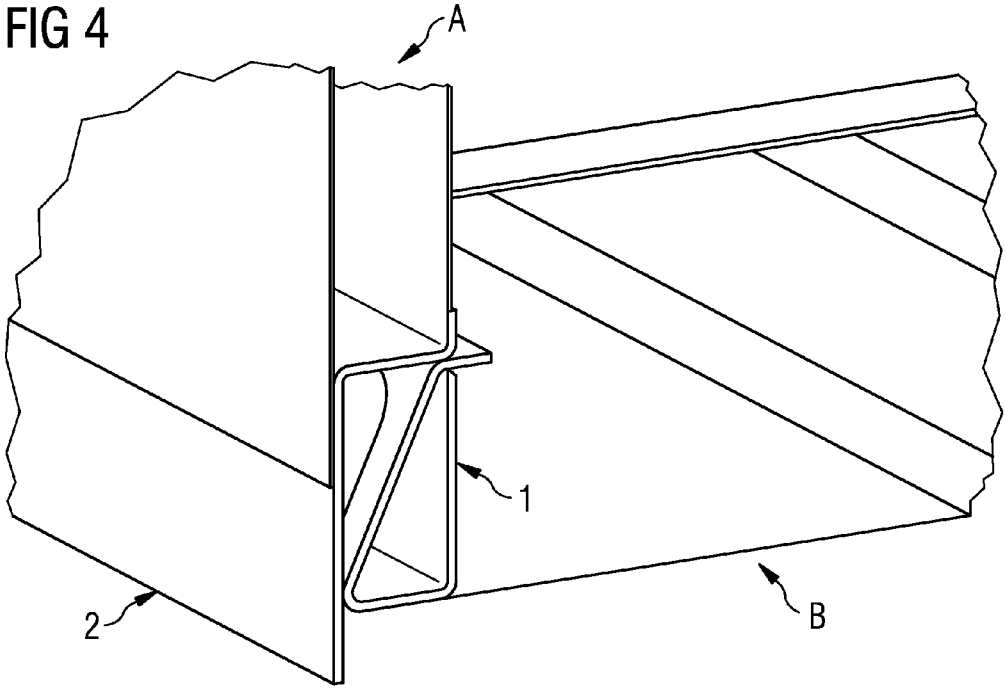
FIG. 4 Reinforced longitudinal beam for railway vehicles, substructure/side wall connection point, exterior view.

FIG. 4 shows in exemplary and schematic fashion an exemplary embodiment of a reinforced longitudinal beam for railway vehicles at the substructure/side wall connection point, exterior oblique view. The exemplary embodiment from FIG. 3 is shown in the exterior view.

Figure 5:
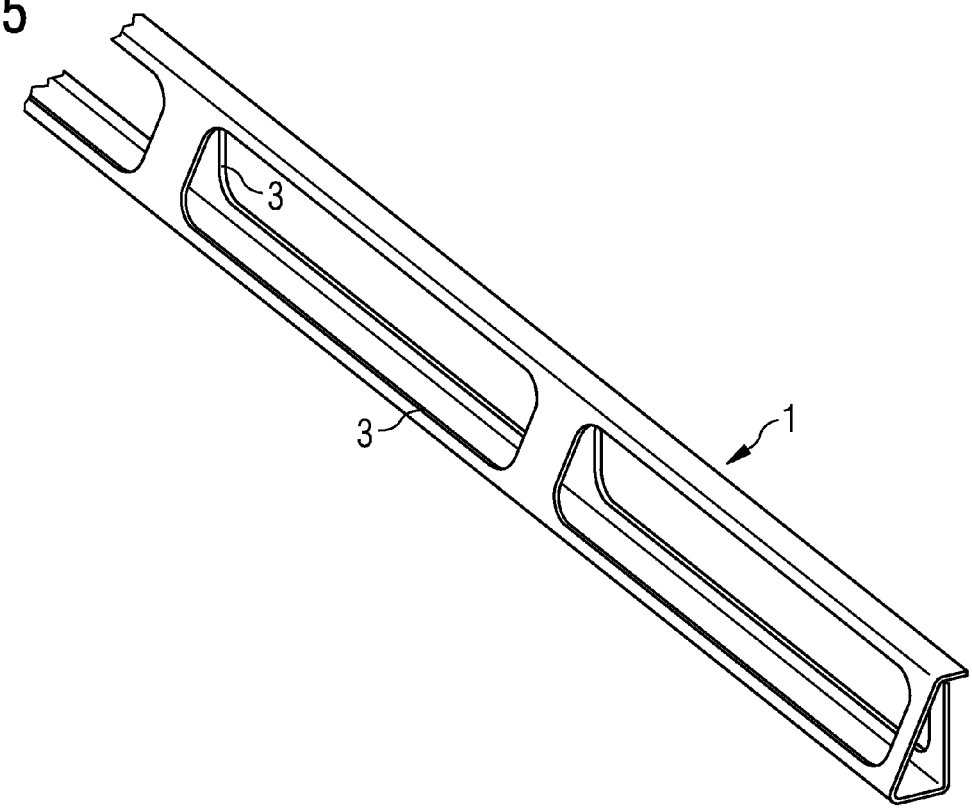
FIG. 5 Reinforced longitudinal beam for railway vehicles.

FIG. 5 shows an exemplary embodiment of a longitudinal beam for railway vehicles. The partial beam 1 of a reinforced longitudinal beam is shown, wherein the partial beam 1 has perforations 3 in the end facing 11 and the bridge 12. On the one hand, these perforations 3 serve to save weight and on the other hand they provide a means of gaining access for the application of rust protection after the completion of welding work.

Figure 6:
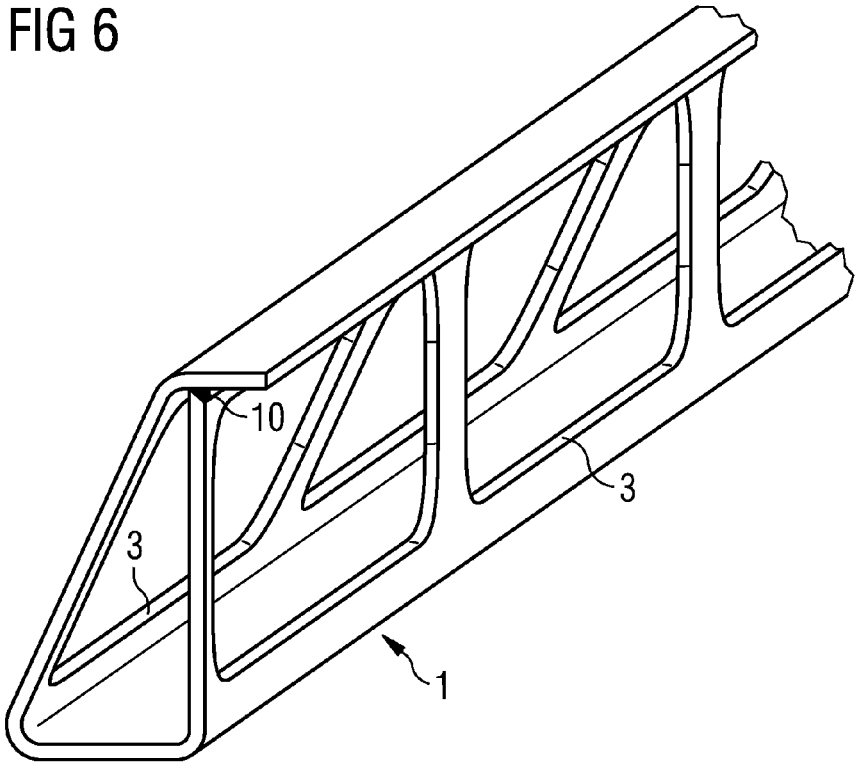
FIG. 6 Reinforced longitudinal beam for railway vehicles, view with welded seam.

FIG. 6 shows an exemplary embodiment of a longitudinal beam for railway vehicles. An oblique view from the inside of the first partial beam 1 from FIG. 5 is shown. A longitudinal beam welded seam 10 closes the essentially triangular profile of the first partial beam 1.

Figure 7:
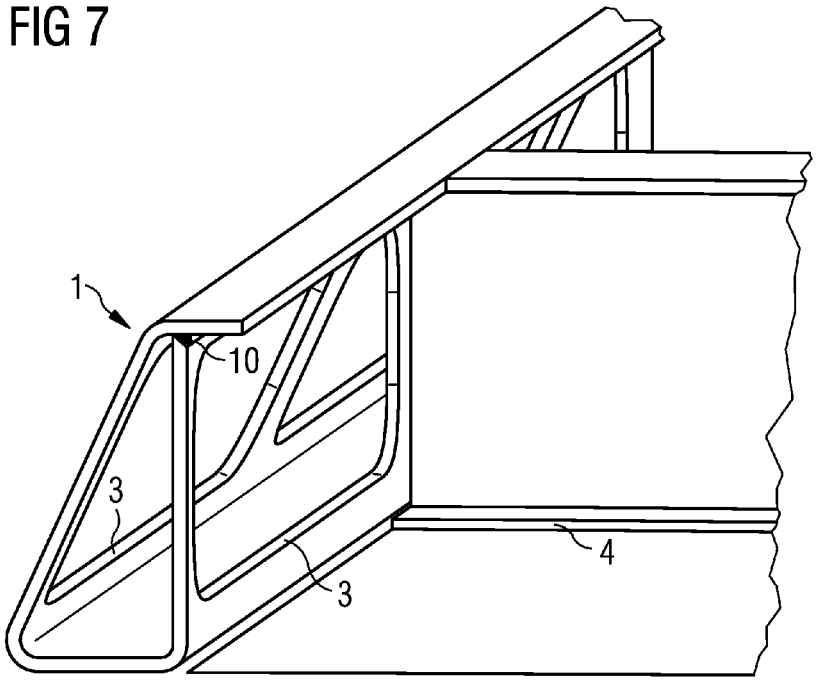
FIG. 7 Reinforced longitudinal beam for railway vehicles, substructure/longitudinal beam connection point.

FIG. 7 shows an exemplary embodiment of a reinforced longitudinal beam for railway vehicles at the substructure/longitudinal beam connection point. The first partial beam 1 from FIG. 6 is shown, to which a cross-member 4 of a substructure is connected. The cross-member 4 is connected to the bridge 12 of the first partial beam 1 between any perforations 3 (welded on). A penetration of the first partial beam 1 with the cross-member 4 is not necessary as the end facing 11 ensures sufficient strength.

Figure 8:
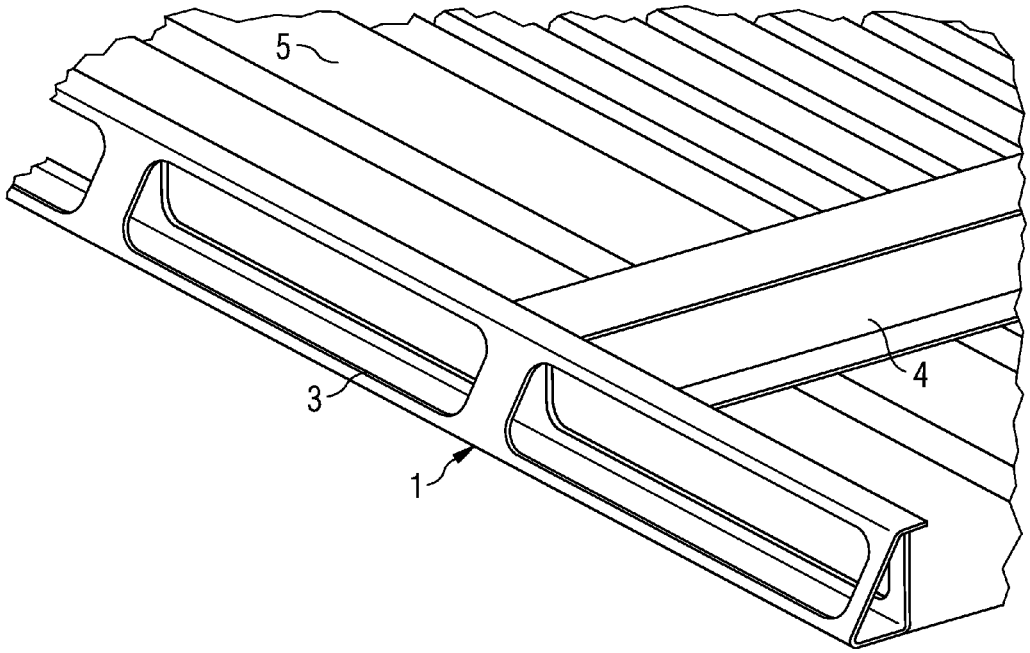
FIG. 8 Reinforced longitudinal beam for railway vehicles, substructure/longitudinal beam connection point, exterior view.

FIG. 8 shows an exemplary embodiment of a reinforced longitudinal beam for railway vehicles at the substructure/longitudinal beam connection point in an exterior oblique view. A partial beam 1 is shown to which a cross-member 4 of a substructure is connected. In addition, this substructure has a covering 5. In contrast to the exemplary embodiment shown in FIG. 7, the first partial beam 1 in this exemplary embodiment has only one perforation 3 in the end facing 11. There is no perforation in the bridge 12 of the first partial beam 1, as may be advantageous for example in railway vehicles made of non-rusting materials.

Figure 9:
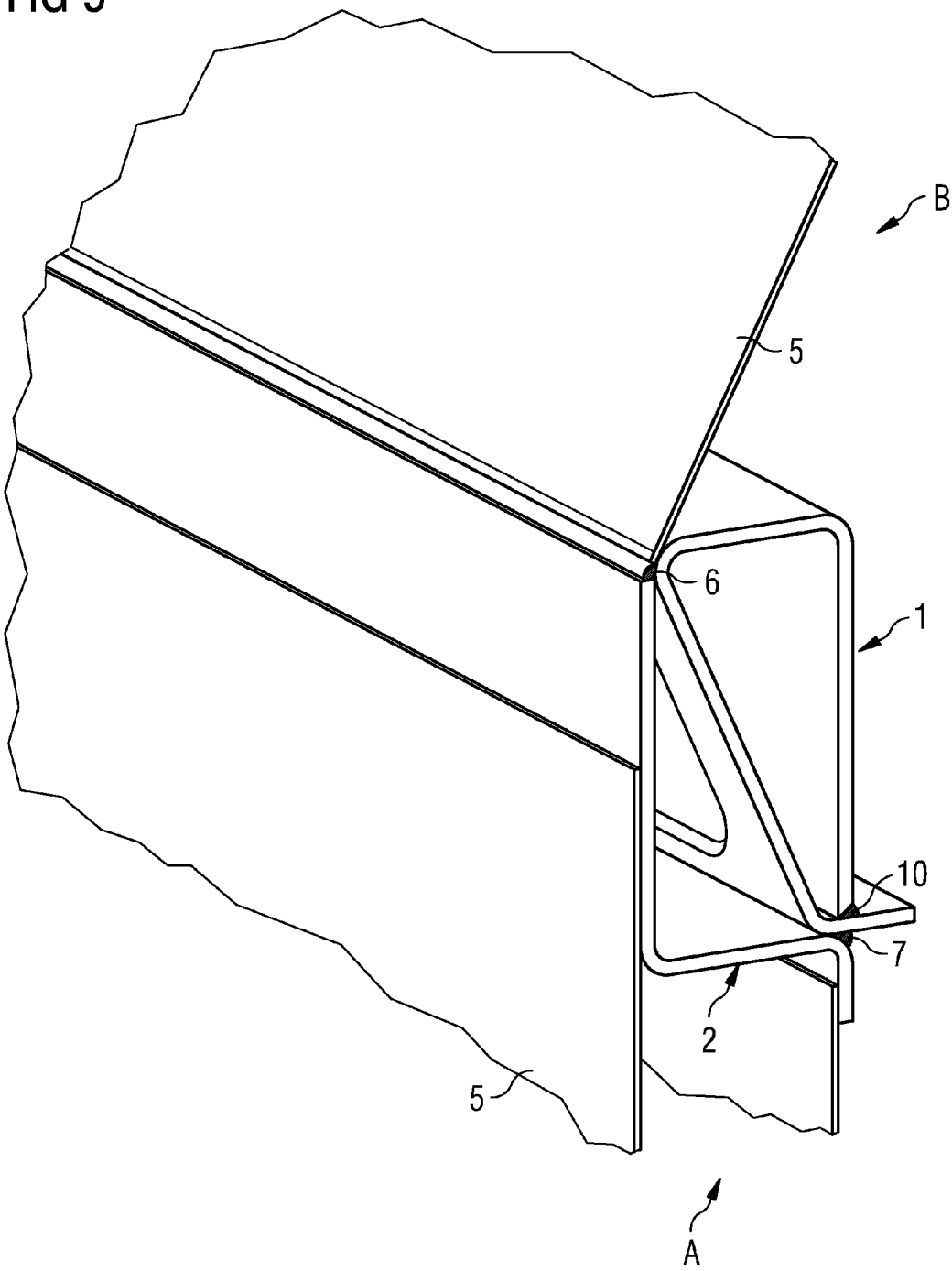
FIG. 9 Reinforced longitudinal beam for railway vehicles, side wall/roof connection point.

FIG. 9 shows an exemplary embodiment of a reinforced longitudinal beam at the side wall/roof connection point in an exterior oblique view. The longitudinal beam comprises a first partial beam 1 and a second partial beam 2. The first partial beam 1 has an essentially triangular profile and is welded by means of the longitudinal beam welded seam 10. A second assembly B (a roof) is connected to the first partial beam 1, wherein the covering 5 of the roof is shown in FIG. 9 (additional components, for instance roof joists, are not shown for simplification). The second partial beam 2 is formed as an essentially L-shaped profile and is connected to a first assembly A (a side wall), wherein the covering 5 of this side wall is shown. An external welded seam 6 and an internal welded seam 7 connect both partial beams 1 and 2 to each other and therefore also the assemblies A and B connected to the partial beams 1, 2. These welded seams 6 and 7 are straight and unbroken.

Figure 10:
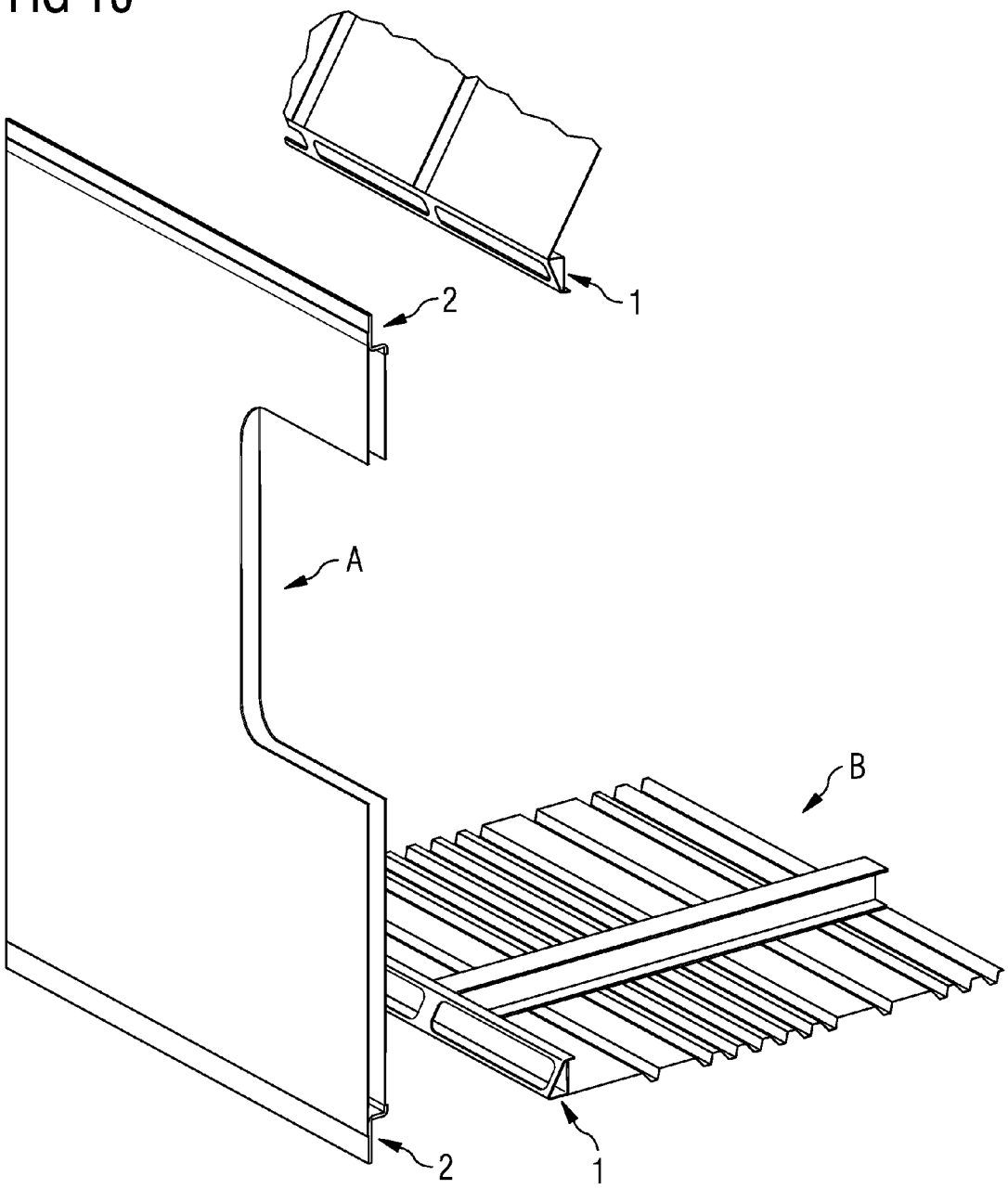
FIG. 10 Reinforced longitudinal beam for railway vehicles, general view.

FIG. 10 shows an exemplary embodiment of a reinforced longitudinal beam. To clarify the principle of a divided reinforced longitudinal beam according to the invention the structure of a railway vehicle is shown, wherein a reinforced longitudinal beam is provided to connect the substructure to a side wall and a side wall to the roof respectively.

A first assembly A is connected to a second partial beam 2 at its upper and lower ends respectively. Two second assemblies B (a substructure, a roof) are each equipped with a reinforced first partial beam 1 at the connecting line to the first assembly A. In this way the aforementioned assemblies can be connected to each other via straight, unbroken welded seams 6, 7 (FIG. 3, FIG. 9) and can consequently be readily manufactured using automation.

The invention claimed is:

1. A reinforced longitudinal beam for a railway vehicle, comprising:

a first partial beam having a closed triangular profile with first surfaces, a second partial beam having an open L-shape profile with second surfaces, wherein the longitudinal beam is divided in the longitudinal axis into the first partial beam and the second partial beam, wherein the first partial beam is connected to a second assembly of the railway vehicle, wherein the second partial beam is connected to a first assembly of the railway vehicle, wherein the first surfaces of the first partial beam form a welded connection to the second partial beam and the second surfaces of the second partial beam form a welded connection to the first partial beam, wherein one of the partial beams has an end facing, and wherein the partial beams are each formed from sheet metal in one piece.

2. The reinforced longitudinal beam as claimed in claim 1, wherein the longitudinal beam formed from the first partial beam and the second partial beam has a closed profile.

3. The reinforced longitudinal beam as claimed in claim 1, wherein the closed triangular profile of the first partial beam comprises a bridge, a flange to extend from an end of the bridge in an orthogonal direction relative to the bridge and an end facing to extend to an opposite end of the bridge to the end of the bridge from which the flange extended, and the open L-shape profile of the second partial beam comprises a bridge and a flange that is oriented orthogonal relative to the bridge.

4. The reinforced longitudinal beam as claimed in claim 1, wherein the first assembly of the railway vehicle is a side wall and the second assembly is a substructure.

5. The reinforced longitudinal beam as claimed in claim 1, wherein the first assembly of the railway vehicle is a side wall and the second assembly is a roof.

6. A railway vehicle, comprising:

a wagon body made of metal, which is divided into a substructure, side walls and a roof, a reinforced longitudinal beam for connecting the substructure to the side walls or to the roof, the reinforced longitudinal beam comprising:

a first partial beam having a closed triangular profile with first surfaces, a second partial beam having an open L-shape profile with second surfaces, wherein the longitudinal beam is divided in the longitudinal axis into the first partial beam and the second partial beam, wherein the first partial beam is connected to a second assembly of the railway vehicle, wherein the second partial beam is connected to a first assembly of the railway vehicle, wherein the first surfaces of the first partial beam form a welded connection to the second partial beam and the second surfaces of the second partial beam form a welded connection to the first partial beam, wherein one of the partial beams has an end facing, and wherein the partial beams are each formed from sheet metal in one piece.

7. The railway vehicle as claimed in claim 6, wherein the longitudinal beam formed from the first partial beam and the second partial beam has a closed profile.

8. The railway vehicle as claimed in claim 6, wherein the closed triangular profile of the first partial beam comprised a bridge, a flange to extend from an end of the bridge in an orthogonal direction relative to the bridge and an end facing to extend to an opposite end of the bridge to the end of the bridge from which the flange extended, and the open L-shape profile of the second partial beam comprises a bridge and a flange that is orthogonal relative to the bridge.

9. A reinforced longitudinal beam for a railway vehicle, comprising:

a first partial beam including a bridge, a flange and an end facing forming a closed triangular profile, said first partial beam with first surfaces, a second partial beam including a bridge and a flange forming an open L-shaped profile, said second partial beam with second surfaces, wherein the longitudinal beam is divided in the longitudinal axis into the first partial beam and the second partial beam, wherein the first partial beam is connected to a second assembly of the railway vehicle, wherein the second partial beam is connected to a first assembly of the railway vehicle, wherein the first surfaces of the first partial beam form a welded connection to the second partial beam and the second surfaces of the second partial beam form a welded connection to the first partial beam based on a plurality of welded seams, a first welded seam between an end of the bridge of the first partial beam with an end of the end facing of the first partial beam, to close the triangular profile of the first partial beam;

a second welded seam between a corner of the triangular profile of the first partial beam and an inner surface of the bridge of the second partial beam; and a third welded seam between an end of the flange of the second partial beam an end of the inner facing of the first partial beam, wherein the second and third welded seams close the connection between the first and second partial beams.

* * * * *